United States Patent [19]

Kimura et al.

[11] Patent Number: 4,966,175

[45] Date of Patent: Oct. 30, 1990

[54] HAIR COSMETICS COATING TOOL

[75] Inventors: Masaru Kimura, Gunma; Yoshiomi Konose, Fujioka; Yuji Nakamura, Suita, all of Japan

[73] Assignee: Mitsubishi Pencil Co., Ltd., Tokyo, Japan

[21] Appl. No.: 355,826

[22] Filed: May 22, 1989

Related U.S. Application Data

[63] Continuation of Ser. No. 135,410, Dec. 21, 1987, abandoned.

[30] Foreign Application Priority Data

Dec. 9, 1986 [JP] Japan ..... 61-189638[U]
Dec. 9, 1986 [JP] Japan ..... 61-189639[U]

[51] Int. Cl.[5] ..... A45D 24/22; A45D 24/16

[52] U.S. Cl. ..... 132/112; 132/116; 132/120; 401/278; 401/287; 401/291

[58] Field of Search ..... 401/273, 286, 278, 291, 401/288, 287, 282; 132/112, 116, 120

[56] References Cited

U.S. PATENT DOCUMENTS

| | | | |
|---|---|---|---|
| 1,196,522 | 8/1916 | Christiansen | 132/120 |
| 2,304,665 | 12/1942 | Smith et al. | 132/120 |
| 2,672,875 | 3/1954 | Kovacs | 132/112 |
| 2,998,822 | 9/1961 | Birch . | |
| 3,059,652 | 10/1962 | Thomas | 132/120 X |
| 4,209,.027 | 6/1980 | Morganroth . | |

FOREIGN PATENT DOCUMENTS

| | | | |
|---|---|---|---|
| 857851 | 7/1949 | Fed. Rep. of Germany | 132/120 |
| 883863 | 4/1943 | France | 401/291 |
| 2577474 | 8/1986 | France . | |
| 2172797 | 10/1986 | United Kingdom | 401/278 |

*Primary Examiner*—Steven A. Bratlie
*Attorney, Agent, or Firm*—Armstrong, Nikaido, Marmelstein, Kubovcik & Murray

[57] ABSTRACT

A hair cosmetics coating tool comprising a main cylindrical body, a liquid hair cosmetics storage part provided in the main cylindrical body, a brush provided at the top of the main cylindrical body, a supply device for supplying the liquid hair cosmetics from the storage part to the brush and a comb body provided adjacent to and along the brush.

6 Claims, 3 Drawing Sheets

HAIR COSMETICS COATING TOOL

This application is a continuation of application Ser. No. 135,410 filed Dec. 21, 1987 now abandoned.

BACKGROUND OF THE INVENTION

1. Field of the Invention

The present invention relates to a hair cosmetics coating tool and, more particularly, a coating tool for a hair coloring agent, a hair dyeing agent, a hair bleaching agent, a hair setting agent, a permanent wave agent, a hair treatment agent and other hair cosmetics.

2. Prior Art

For example, when hair is dyed with a temporary hair dyeing agent known in the prior art such as a mass color type, a brush etc. must be dipped in the hair dyeing agent stored in a vessel every time to dye the hair, requiring extremely tedious work. In addition, when the brush, etc. is pulled out of the vessel, the brush may touch the mouthpiece of the vessel possibly splashing the dyeing agent.

Another disadvantage of the method known in the prior art is that the dyeing agent directly contacts the skin of the person being treated on the borders of the hair from the brush during dyeing.

Such disadvantages also occur with a tool for coating a hair bleaching agent, permanent or semi-permanent dyeing agent, hair setting agent, permanent wave agent, hair treatment agent and other hair cosmetics.

One object of the present invention is to provide a coating tool which is conveniently used like writing with a pen gripped in a user's hand without requiring the tedious work of dipping the brush into hair cosmetics stored in a vessel.

Another object of this invention is to present a coating tool of an extremely simple and novel structure with which the contact of a hair treating agent on the skin near the borders of the hair by a brush is effectively prevented during coating and, even when a contact preventive member itself is soiled with a dyeing agent or dirt adhering on the hair, the adhesion preventive member can be easily cleaned.

Still another object of the present invention is to offer a hair cosmetics coating tool which is particularly convenient for coating a part of hair when a hair bleaching agent, permanent or semi-permanent dyeing agent, hair setting agent, permanent wave agent or hair treatment agent is used, while effectively preventing the cosmetics from contacting on the skin of the person being treated.

Another object of this invention is to provide the hair cosmetics coating tool of a novel structure with which, even when a contact preventive member itself is soiled with the cosmetics or dirt sticking to the hair, the contact preventive member is easily cleaned.

SUMMARY OF THE INVENTION

The present invention provides a tool for coating hair cosmetics, comprising a main cylindrical body, a storage part equipped in said main cylindrical body for storing a liquid hair cosmetic, a brush equipped at the top part of the main cylindrical body, a supply means of the liquid hair cosmetic located from the storage part to the brush and a comb body attached adjacent to the brush.

The comb body is preferably provided detachably. It is also preferable that a valve means for controlling the supply of the liquid hair cosmetics to the brush be provided in the pen type coating tool for hair cosmetics.

The supply means may be constituted by communicating bristle root holes of the brush with the storage part In addition, the supply means may be constructed by providing small holes adjacent to the bristle root holes and communicating with the storage part.

It is also preferable that the storage part for the liquid hair cosmetics comprises a detachable cartridge.

DETAILED DESCRIPTION AND THE PREFERRED EMBODIMENTS OF THE INVENTION

Figure 1:
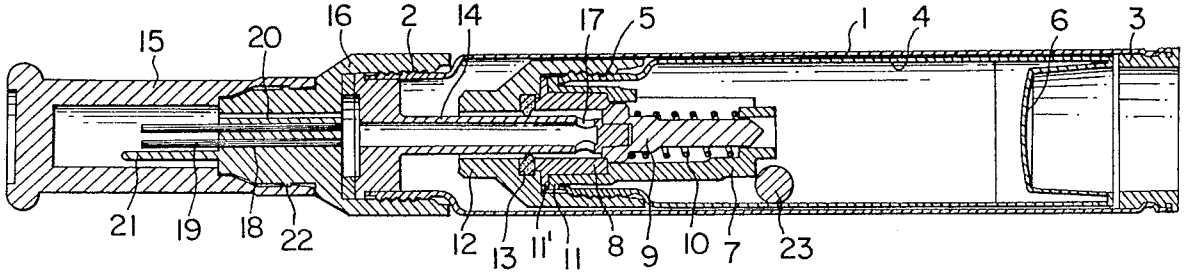
FIG. 1 shows a longitudinal section at the center of a hair dyeing tool constructed in accordance with the present invention.

The present invention is described in detail in the following paragraphs referring to the drawings showing the pen type hair dyeing tool constructed according to this invention. However, the invention is not limited thereby. Similar parts and members in the drawings are symbolized by the same numbers.

Figure 2:
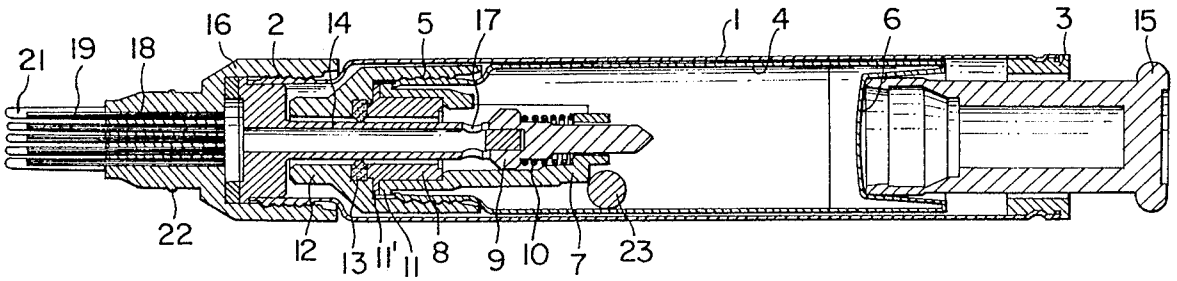
FIG. 2 is a longitudinal section at the center, similar to FIG. 1, in which the valve device of a hair dyeing tool of FIG. 1 is open.
Figure 3:
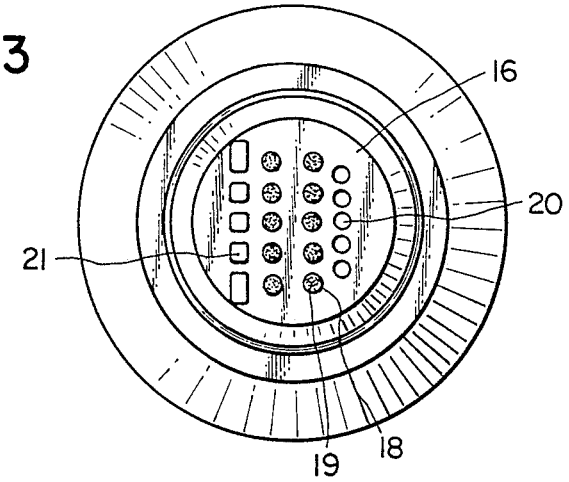
FIG. 3 is an expanded front view of a dyeing tool of FIG. 5.

FIGS. 1–3 show a pen type hair dyeing tool integrated with a comb body.

Referring to the drawings, 1 shows a cylindrical shaft with both ends opened. At the front end, the diameter is made slightly smaller and is cut with male threads 2. At the rear open end, a cylindrical tail plug 3 is fixed with its center part opened.

Number 4 shows a cartridge type storage tank or cylindrical reservoir member for hair dyeing liquid, which is mounted in a free moving manner in longitudinal direction inside the cylindrical shaft 1. This cartridge type storage tank 4 is detachable. This storage tank 4 is provided with an open front end and a closed rear end, in the same structure as conventional cartridge type tanks. The diameter of the front end is made slightly small, where male threads 5 are machined at a part of smaller diameter. At the rear end, a recess 6 is formed. Inside the front open end of said storage tank 4, there is a valve device comprising a spring seat 7, valve seat 8, valve stem 9 and a valve spring 10. With this embodiment, a valve device is used for controlling the supply of a hair dyeing liquid. However, a differently structured means may be used.

A fixed member 12 is screwed in the male part 5 of the storage tank 4. The spring seat 7 and the flange parts 11, 11' of the valve seat 8 are sandwiched between the fixed member 12 and the open top edge of the tank 4. The fixed member 12 is provided with a center hole that communicates to the storage tank 4 through the valve device. A squeeze packing 13 is provided at the boundary between the inner wall face of the center hole and the valve seat 8.

A lead tube 14 is fixed at the front open part of the cylindrical shaft 1, for supplying hair dyeing liquid from the storage tank 4 to a coating part. The lead tube 14 penetrates the center hole of the fixed member 12 and its rear end reaches the interior of the spring seat 7 in connection with the valve stem 9.

The storage tank 4, valve device, squeeze packing 13 and the fixed member 12 are freely movable with respect to the lead tube 14. The squeeze packing 13 seals the outer periphery of the lead tube 14 preventing leaking of a hair dyeing liquid from the storage tank 4.

The valve device is opened when the storage tank 4 is advanced towards the lead tube 14 by an external force as shown in FIG. 2, as the valve stem 9 is pushed by the lead tube 14 while being separated from the valve seat 8 overcoming the force of the valve spring 10. With the external force removed, the storage tank 4 is driven backwardly in relation to the lead tube 14 by the force of the valve spring 10, as shown in FIG. 1, seating the valve stem 9 and closing the valve. When no external force is applied, the valve device maintains a closed state as shown in FIG. 1, by the function of the valve spring 10.

Forward driving of the storage tank 4, in order to open the valve, is obtained as follows. A cap 15 is removed from the top member 16 and inserted into the cylindrical shaft 1 penetrating the rear tail plug 3 of the cylindrical shaft 1 and engaging the cap 15 in the rear recess 6. Thereafter, the cap 15 is pushed inwardly.

When the valve is opened, the storage tank 4 is communicated with the lead tube 14 through a lead-in hole 17 equipped at supplying rear end of the lead tube 14, thus the hair dyeing liquid stored in the storage tank 4 to a coating portion through the lead-in hole 17 and lead tube 14.

The top part member 16, comprising a brush 19, a comb body 21 and small holes 20, is screwed onto the front end male threads 2 of the cylindrical shaft 1. Bristle root holes 18 of small diameter are drilled in two rows in a longitudinal direction substantially at the center portion of the top part member 16, and retain the brush 19 comprising fiber bundles embedded therein.

At a portion adjacent to the bristle root holes 18, small holes 20 are arranged parallel to the longitudinal direction of the bristle root holes 18 and conduct hair dyeing liquid or vent air. These bristle root holes 18 and small holes 20 are communicated with the lead tube 14.

The hair dyeing liquid, after passing through the lead tube 14, is supplied to the root portion of the brush 19 through bristle root holes 18 and the small holes 20.

A comb body 21 is provided at the top face of the top part member 16 in an integrated manner, at a portion opposite to the small holes 20 and adjacent to the rows of brush 19 and in parallel to the longitudinal direction of the rows of said brush 19.

The length of the comb body 21 is determined so that a top portion is slightly protruded above the top of the brush 19. Thus, direct contact of the brush 19 to the skin is prevented. In addition, contact of the hair cosmetics to the skin near the borders of hair by means of the brush is also prevented, by locating this comb body between the brush and the skin during coating since the comb body is equipped along the outer peripheral portion of the brush.

The teeth of the comb body 21 are separated from each other at the same intervals as those between each bundle of the brush 19, and also having the same width as that of each bundle of the brush 19. It is preferred that the comb body 21 extend wider than the outer width of the brush 19.

When this coating tool is not used, the cap 15 is covers the coating part comprising the brush 19 and the comb body 21, at the top of the coating tool as shown in FIG. 1. An elevated part 22 is provided the outer periphery of the top part member 16 to hold the cap 15. When using the coating tool, this cap 15 is removed and inserted at the rear part of the cylindrical shaft 1 for using as a knocking member.

23 shows a metal ball for stirring the hair dyeing agent.

Figure 5:
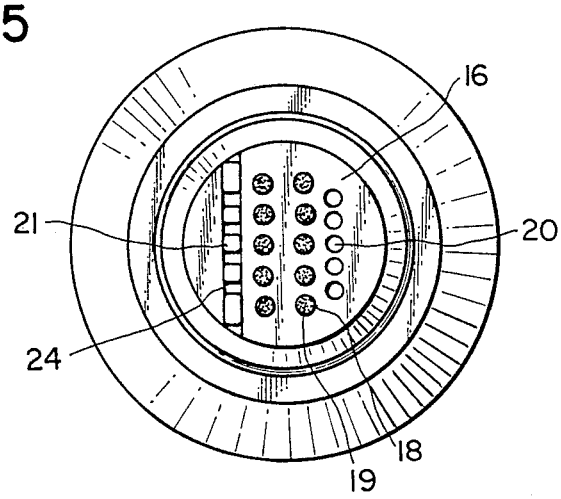
FIG. 5 is an expanded front view of the hair dyeing tool shown in FIG. 4.
Figure 4:
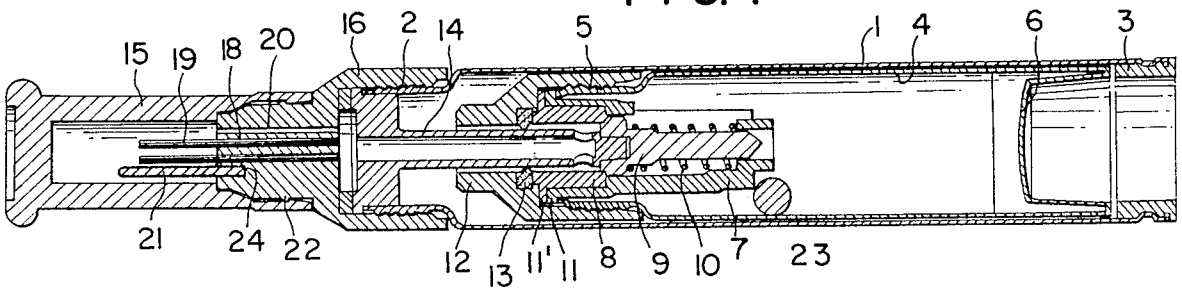
FIG. 4 is a view of the hair dyeing tool of another embodiment, similar to FIG. 1.

FIGS. 4 and 5 show another embodiment of the hair dyeing tool. With this embodiment, the comb body is provided detachably.

At the top end face of the top part member 6, a groove 24 of a constant depth is provided parallel to the rows of the brush 19 at a portion opposite and adjacent to the small holes 20. A comb body 21, another independent member, is detachably engaged in the groove 24. As the comb body 21 is freely detachable, the comb body is easily cleaned even when the comb body itself is soiled with hair cosmetics or dirt adhering to hairs. In this manner, the comb body can be neatly maintained. Thus, indirect contact of the hair cosmetic onto the skin, due to a soiled comb body, is also prevented.

Figure 6:
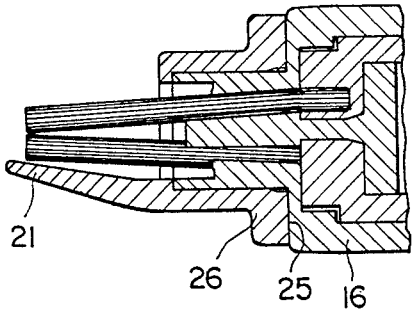
FIG. 6 shows a longitudinal section at a part, similar to FIG. 1, of a hair dyeing tool of another embodiment of the hair dyeing tool.

FIG. 6 shows a third embodiment.

With this embodiment, the base part of the comb body 21 is formed in a ring having a shape such that the outer top portion 25 of the top part member 16 is exactly engaged with the base part 26 of the ring form.

The comb body, in any of the foregoing embodiments, is fixed by friction force. However, a separate fixing means may also be provided for fixing the comb body. Where the comb body is not equipped integrally, the method of fixing the comb body may be freely selected as long as the comb body is freely detachable.

In addition, the shape of the comb body is not restricted particularly. For example, the teeth of the comb body may be either straight or rectangularly curved.

In all three embodiments shown above, the top part member 16 is screwed onto the cylindrical shaft 1 while the brush 19 integrally embedded in the top part member 16. However, such another structure is also employable that a top part member comprises a top shaft to be screwed onto the cylindrical shaft 1 and a base carrying a brush embedded as a separate part, with the base engaged with the top shaft. In such an embodiment, the comb body may be made freely detachable to any of the top shaft or the base.

Furthermore, the present invention is applicable to a coating tool not only for use with a temporary hair dyeing agent but also for use with a hair bleaching agent, permanent or semi-permanent hair dyeing agent, hair setting agent, permanent wave agent, hair treatment agent, etc. with the same functions and effects.

What is claimed is:

1. A hair cosmetic coating tool which comprises:

(a) a main cylindrical body;

(b) a cylindrical reservoir member for storing liquid hair cosmetics and slidably mounted in said main body;

(c) an applicator head having two rows of plural brush tufts implanted therein and extending forwardly therefrom with individual bristles for each tuft converging at the tip to control the liquid application;

(d) a supply means communicating from said reservoir member to said brush tufts to supply cosmetic liquid to said brush tufts;

(e) a valve unit to control said supply means having a knocking member mounted at the rear end of said main body; and (f) a comb member having teeth extending forwardly from said applicator head for a distance greater than the length of said brush tufts and disposed adjacent to one of said two rows of said brush tufts, said teeth being bent toward said one of said two rows of brush tufts so as to contact with the brush tufts of that row.

2. The hair cosmetics coating tool as set forth in claim 1, wherein said comb member is provided detachably.

3. The hair cosmetics coating tool as set forth in claim 1, wherein said supply means comprises bristle root holes of said brush tufts, in communication with the reservoir member.

4. The hair cosmetics coating tool as set forth in claim 1, wherein said supply means comprises small holes that are provided adjacent to bristle root holes of said brush tufts and in communication with the reservoir member.

5. The hair cosmetics coating tool as set forth in claim 1, wherein said supply means comprises bristle root holes of said brush tufts and small holes, said bristle root holes being in communication with the reservoir member and said small holes being provided adjacent to the bristle root holes of said brush tufts and in communication with the reservoir member.

6. The hair cosmetics coating tool as set forth in claim 1, wherein the reservoir member comprises a detachable cartridge.

* * * * *